US011103766B2

(12) United States Patent
Schwanke et al.

(10) Patent No.: US 11,103,766 B2
(45) **Date of Patent: *Aug. 31, 2021**

(54) REMOVABLE PAD ARRANGEMENT

(71) Applicant: Under Armour, Inc., Baltimore, MD (US)

(72) Inventors: Richard Schwanke, Baltimore, MD (US); Jedd Komlos, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/455,293

(22) Filed: Jun. 27, 2019

(65) Prior Publication Data

US 2019/0388768 A1 Dec. 26, 2019

Related U.S. Application Data

(63) Continuation of application No. 15/478,995, filed on Apr. 4, 2017, now Pat. No. 10,376,768.

(60) Provisional application No. 62/318,934, filed on Apr. 6, 2016.

(51) Int. Cl.

| | |
|---|---|
| ***A63B 71/12*** | (2006.01) |
| ***A41D 13/05*** | (2006.01) |
| ***A41D 13/08*** | (2006.01) |

(52) U.S. Cl.

CPC ..... *A63B 71/12* (2013.01); *A41D 13/0575* (2013.01); *A41D 13/08* (2013.01)

(58) Field of Classification Search

CPC .. A41D 13/08; A41D 13/0593; A41D 13/015; A41D 13/0015; A41D 13/0575; A41D 13/0012; A41D 27/20; A41D 27/205; A41D 2600/10; A41C 3/0035; A63B 71/12; A63B 2071/1258; A63B 2071/125

USPC ..... 2/16, 24, 247, 250

See application file for complete search history.

(56) References Cited

U.S. PATENT DOCUMENTS

| | | | | | |
|---|---|---|---|---|---|
| 789,672 | A | * | 5/1905 | Reiner | A41D 27/20 2/249 |
| 1,664,460 | A | * | 4/1928 | Mayer | A41D 27/20 2/247 |
| 2,629,094 | A | * | 2/1953 | Goldsmith | A41D 1/08 2/23 |
| 3,135,961 | A | * | 6/1964 | Roderick | A41D 13/015 2/267 |
| 3,911,497 | A | * | 10/1975 | Lewis, Jr. | A41D 13/08 128/881 |
| 3,970,305 | A | * | 7/1976 | Hawkins | A63B 71/14 473/62 |
| 4,388,734 | A | * | 6/1983 | Cowden | A45C 13/185 2/250 |

(Continued)

OTHER PUBLICATIONS

Birtwhistle, Fern, STIC Search Results, Mar. 7, 2019.

*Primary Examiner* — Heather Mangine

(74) *Attorney, Agent, or Firm* — Maginot, Moore & Beck LLP

(57) ABSTRACT

A guard arrangement includes a sleeve with a pocket defining an adjustable opening that has a nominal width, and a pad element having a first portion and a second portion. The first portion is configured to be removably positioned inside the pocket, and the first portion has a width at a widest part of the first portion that is greater than the nominal width of the opening.

19 Claims, 9 Drawing Sheets

(56) References Cited

U.S. PATENT DOCUMENTS 4,593,416 A * 6/1986 Figgie, III ..... A41D 13/0568 2/24
4,627,108 A * 12/1986 Jarvinen ..... A41D 13/065 2/22
4,876,745 A * 10/1989 Richards ..... A41D 13/0568 2/24
5,456,658 A * 10/1995 Duback ..... A41D 13/0153 2/22
5,477,558 A * 12/1995 Volker ..... A41D 13/0153 2/16
5,497,511 A * 3/1996 Zade ..... A41D 13/015 2/22
5,566,389 A * 10/1996 Li ..... A41D 13/088 2/16
5,594,954 A * 1/1997 Huang ..... A41D 13/065 2/16
5,729,832 A * 3/1998 Grilliot ..... A41D 13/00 2/2.5
5,794,261 A * 8/1998 Hefling ..... A41D 13/065 2/16
5,840,397 A * 11/1998 Landi ..... A41D 13/05 428/73
5,974,586 A * 11/1999 Reinoso ..... A41D 13/08 2/125
6,098,208 A * 8/2000 Cordon ..... A63B 71/08 2/16
6,119,275 A * 9/2000 Goyal ..... A41B 9/001 2/228
6,131,195 A * 10/2000 Foreman ..... A63B 71/1225 128/882
6,154,888 A * 12/2000 Krohn ..... A41D 27/20 2/250
6,374,408 B1 * 4/2002 Tomlinson ..... A41D 13/0568 2/16
6,393,610 B1 * 5/2002 Parks ..... A41D 13/0568 128/882
6,421,839 B1 * 7/2002 Vo ..... A41D 13/0575 2/227
6,427,239 B1 * 8/2002 Worden ..... A41D 13/065 2/22
6,553,573 B1 * 4/2003 Brown ..... A41D 13/08 2/24
7,216,370 B1 * 5/2007 Warner ..... A41D 13/0575 2/23
7,404,242 B1 * 7/2008 Perler ..... A43B 3/0078 2/245
8,434,163 B1 * 5/2013 Nudo ..... A41D 13/0051 2/102
8,484,763 B1 * 7/2013 Lucas ..... A41C 3/0057 2/89
8,510,862 B1 * 8/2013 Contant ..... A63B 71/1225 2/22
8,771,036 B2 * 7/2014 Gentry ..... A41C 3/12 2/247
9,149,073 B1 * 10/2015 Hirshberg ..... A41B 5/00
9,167,856 B1 * 10/2015 Pacific ..... A41D 13/065
9,295,288 B1 * 3/2016 Goff ..... A41C 3/0035
9,616,315 B2 * 4/2017 Smith ..... A63B 71/1225
9,675,124 B2 * 6/2017 Vito ..... A41D 13/08
9,723,878 B1 * 8/2017 Goff ..... A41C 3/12
9,763,484 B2 * 9/2017 Conolly ..... A63B 71/1225
9,943,120 B1 * 4/2018 Rendone ..... A41C 3/0014
9,980,525 B2 * 5/2018 Hanna ..... F41H 1/02
2003/0070209 A1 * 4/2003 Falone ..... A41D 13/015 2/412
2004/0045079 A1 * 3/2004 Quintero ..... A41D 13/08 2/455
2005/0203454 A1 * 9/2005 Wiener ..... A41D 13/0506 602/23
2006/0005292 A1 * 1/2006 Crye ..... A41D 13/0575 2/24
2006/0107433 A1 * 5/2006 Olson ..... A61F 5/0104 2/22
2008/0168589 A1 * 7/2008 Richards ..... A41D 13/065 2/24
2010/0242158 A1 * 9/2010 Blakely ..... A41D 13/0512 2/461
2012/0005802 A1 * 1/2012 Claeys ..... A41D 27/20 2/84
2012/0210488 A1 * 8/2012 Blakely ..... A41D 13/08 2/69
2012/0255097 A1 * 10/2012 Feuchs ..... A41D 13/065 2/22
2012/0255105 A1 * 10/2012 Turner ..... A41D 13/0506 2/455
2014/0259325 A1 * 9/2014 Behrend ..... A41D 13/06 2/455
2014/0304900 A1 * 10/2014 Sugano ..... A41D 13/0156 2/455
2016/0213996 A1 * 7/2016 Hammer ..... A63B 71/1225
2016/0262465 A1 * 9/2016 Vito ..... A41D 13/08
2017/0000196 A1 * 1/2017 Rivera ..... A41D 13/08
2017/0036096 A1 * 2/2017 Rudow ..... A63B 71/1225
2017/0055603 A1 * 3/2017 Guidetti ..... A41D 13/0543
2017/0295864 A1 * 10/2017 Turner ..... A41D 13/015
2017/0318873 A1 * 11/2017 Bond ..... A41D 13/08
2017/0340039 A1 * 11/2017 Jur ..... A41D 13/0512
2018/0014587 A1 * 1/2018 Enderlin ..... A41D 15/00
2018/0084846 A1 * 3/2018 Rivera ..... A41D 13/08
2018/0103691 A1 * 4/2018 Alva ..... A41C 3/04

* cited by examiner

REMOVABLE PAD ARRANGEMENT

CROSS-REFERENCE TO RELATED APPLICATION

This application is a continuation application of U.S. application Ser. No. 15/478,995 entitled "Removable Pad Arrangement," filed Apr. 4, 2017, which claims priority to U.S. Provisional Application Ser. No. 62/318,934 entitled "Removable Pad Arrangement," filed Apr. 6, 2016, the disclosures of which are hereby incorporated herein by reference in their entirety.

TECHNICAL FIELD

This disclosure relates generally to athletic protection, and more particularly to athletic padding arrangements.

BACKGROUND

Participants of various sports use elbow guards and other protective gear for preventing potential injuries characteristic of the sport. For instance, baseball players often wear an elbow guard on the elbow that faces toward the pitcher while the player is batting. The elbow guard is designed to protect the elbow joint, particularly the bones at the elbow joint, which are not protected by muscle, from injuries resulting from being struck by the baseball.

One conventional elbow guard includes a padding element sewn or otherwise affixed to one or more elastic straps, hook and loop fastened straps, or other desired straps. These elastic straps are typically intended to stretch against the user's upper arm and forearm for the purpose of securing the elbow pad to the participant's arm. Similarly, the hook and loop straps wrap around the participant's arm so as to secure the elbow pad to the arm. The straps wrapped around a player's arm, however, may be uncomfortable for some players.

In other known elbow guards, the padding element is permanently integrated into a garment that the player wears. For example, the padding element may be sewn into a shirt or a compression sleeve.

While an elbow pad is desirable while the player is batting, the elbow guard may be cumbersome when the player is running, throwing, or fielding. During a baseball game, however, there is limited time for a player to remove the straps or garments to which the padding element is attached. Thus, the player may be forced to play an entire game with the elbow guard to receive protection for the limited instances in which the player is batting.

Accordingly, it would be desirable to provide an elbow guard that may be quickly and easily attached and removed from a player, and which may be comfortably worn by the player.

SUMMARY

According to one embodiment of the disclosure, a guard arrangement comprises a sleeve and a pad element. The sleeve includes a pocket defining an adjustable opening that has a nominal width, and the pad element has a first portion and a second portion. The first portion of the pad element is configured to be removably positioned inside the pocket. The first portion has a width at a widest part of the first portion that is greater than the nominal width of the opening.

In another embodiment, a method of protecting a lead elbow of a baseball or softball batter includes inserting a first portion of a pad element into an adjustable opening defined at a distal end of a pocket of a sleeve, the first portion having a width at a widest part of the first portion that is greater than the nominal width of the opening. The method further includes engaging an intermediate portion of the pad element with the pocket so as to retain the pad element in the pocket, the intermediate portion being located between the first portion and a second portion of the pad element, the second portion extending from the opening of the pocket after the first portion is inserted.

In a further embodiment, a guard arrangement includes an elastic sleeve comprising an elongated sleeve body and a pocket formed by an elastic panel attached to an exterior of the elongated sleeve body. The pocket has a first side and a second side and defines an opening at a distal end of the pocket. The first side defines a first recess and the second side defines a second recess, and a nominal width between the first and second recesses is greater than the nominal width of the opening. The guard arrangement further includes a pad element with a relatively inelastic shell. The pad element has a first portion inserted in the pocket, a second portion extending outside the pocket, and an intermediate portion between the first and second portions engaging the opening.

DETAILED DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be per-formed in the order of presentation.

Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein to refer to lengths, the term "approximately" includes lengths that are included within the wider range of ±20% or ±0.5 cm of the reference value. When used herein to refer to angles, the term "approximately" includes angles that are within ±20° of the reference angle.

Figure 1:
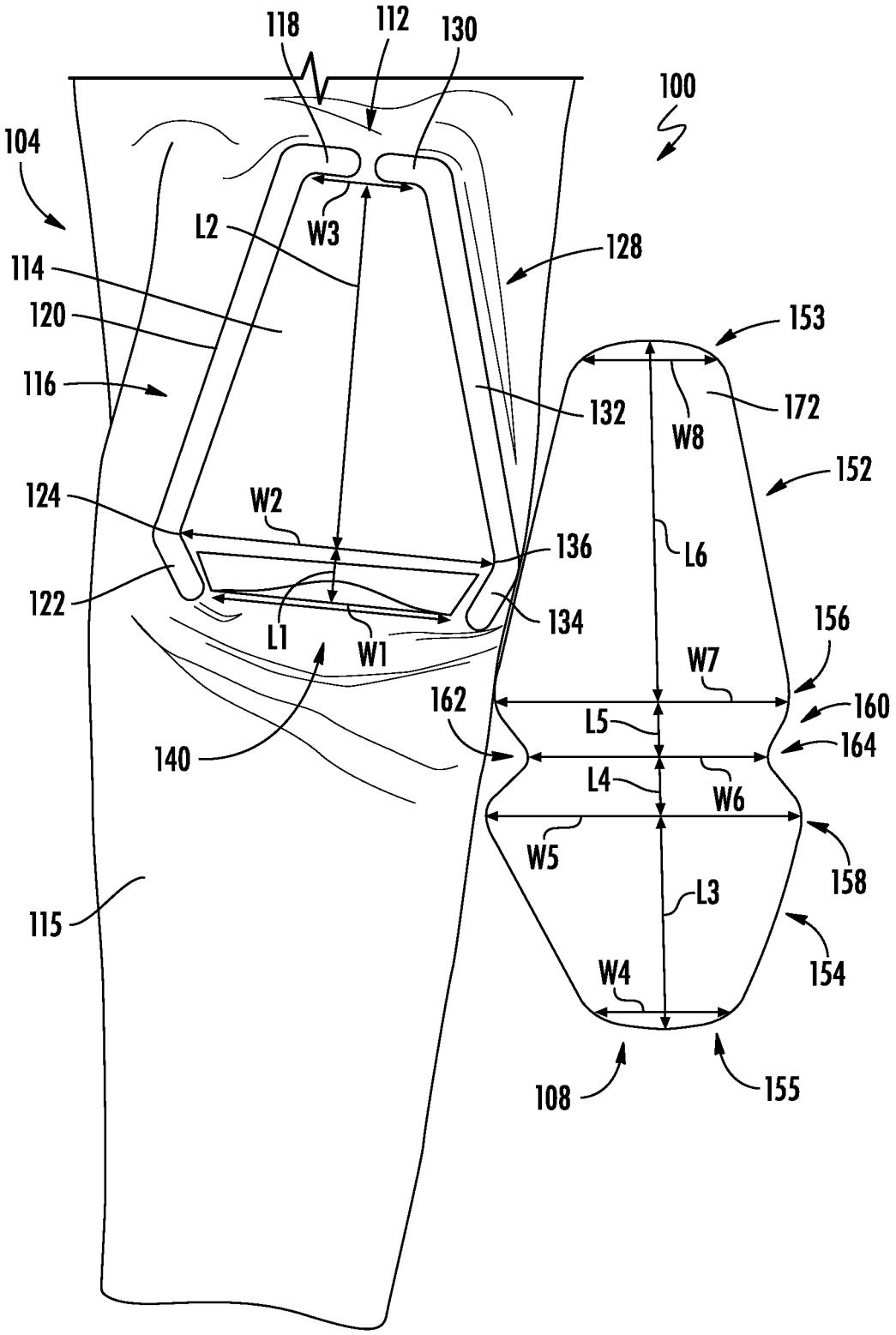
FIG. 1 is a front view of the elbow guard arrangement according the disclosure with a sleeve and a pad element separated from one another.

FIG. 1 illustrates a guard arrangement 100 according to the disclosure. The guard arrangement includes a sleeve 104 and a pad element 108. The pad element 108 is configured to be releasably positioned in a pocket 112 of the sleeve 104 in such a way that the pad element 108 is secured in the pocket 112, but can be removed by the user with ease when desired.

Figure 6:
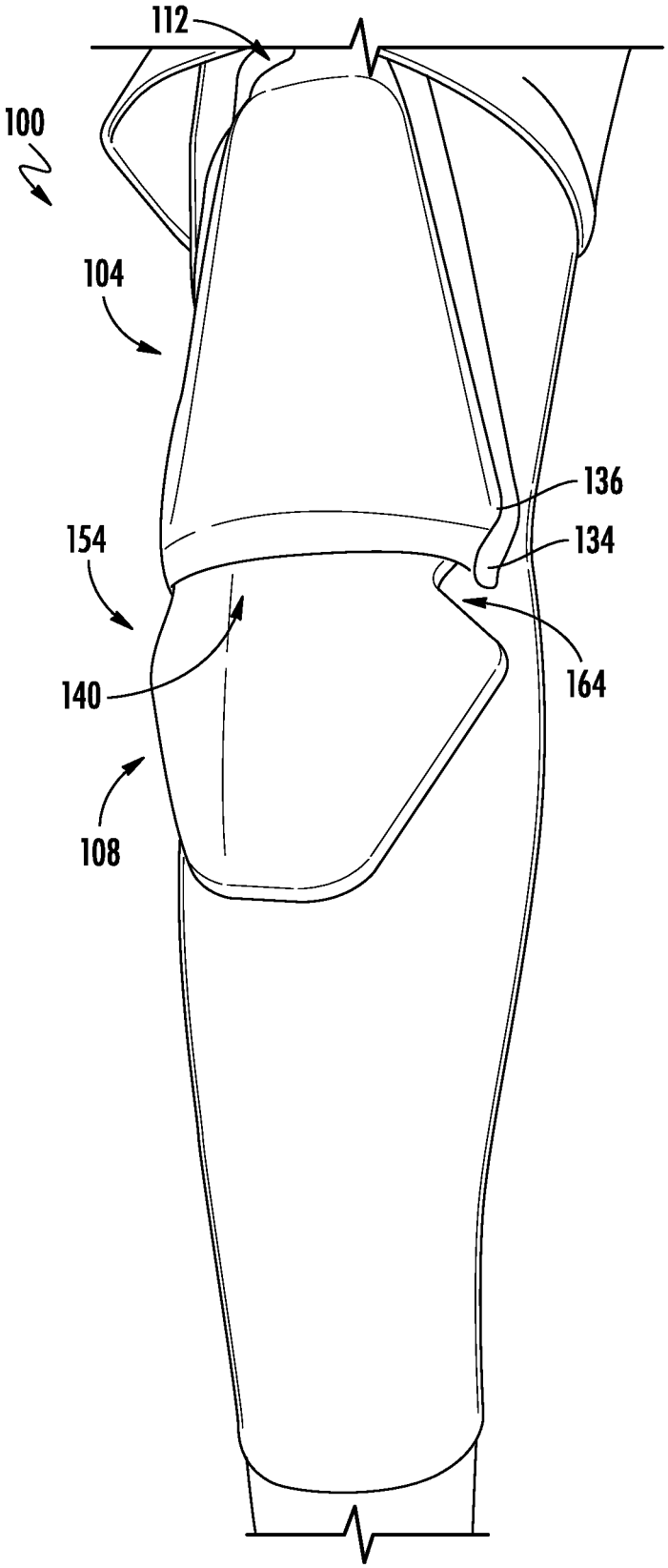
FIG. 6 is a front view of the elbow guard arrangement of FIG. 1 being worn by a user.

The pocket 112 is formed by a fabric panel 114 attached to the outside of an elongated sleeve body 115 of the sleeve 104 by, for example, being stitched, fused, or adhesively bonded to the sleeve. The pocket 112 has a generally trapezoidal shape, and includes a first side 116 and a second side 128 that are attached to the sleeve. An opening 140 into the pocket 112 is defined at the distal end of the pocket 112 between the end of the first side 116 and the end of the second side 128. The opening 140 is defined along a lip at an edge of the pocket 112 that extends between the first side 116 and the second side 128 but is not connected to the sleeve body 115. In the illustrated embodiment, the opening 140 provides a mouth of the pocket that is open in a direction toward the distal end of a user's arm (see FIG. 6).

Referring back to FIG. 1, the first side 116 includes an end leg 118, an outwardly extending leg 120, which extends from the end leg 118 longitudinally towards the opening 140 and outwardly away from the second side 128, and an inwardly extending leg 122, which extends inwardly toward the second side 128 from the end of the outwardly extending leg 120 to the opening 140. A first recess 124 is formed inside the pocket 112 at the intersection between the outwardly and inwardly extending legs 120, 122. In the disclosed embodiment, the first recess 124 defines an interior vertex that forms an interior angle (i.e., the angle formed between the outwardly and inwardly extending legs 120, 122) that is less than 180°. In one embodiment, the interior angle is between 130° and 170°, and in another embodiment, the interior angle is between 145° and 155°.

Likewise, the second side 128 of the pocket 112 includes an end leg 130, an outwardly extending leg 132, which extends from the end leg 130 longitudinally towards the opening 140 and outwardly away from the first side 116, and an inwardly extending leg 134, which extends inwardly toward the first side 116 from the end of the outwardly extending leg 132 to the opening 140. A second recess 136 is formed in the pocket 112 at the intersection between the outwardly and inwardly extending legs 132, 134. In the disclosed embodiment, the second recess 136 defines an interior vertex that forms an interior angle (i.e., the angle formed between the outwardly and inwardly extending legs 132, 134) that is less than 180°. In one embodiment, the interior angle is between 130° and 170°, and in another embodiment, the interior angle is between 145° and 155°. The first and second sides 116, 128 of the pocket are symmetrical about a longitudinal axis extending centrally through the pocket 112 from the distal end to the proximal end of the pocket 112 and, as a result, the first and second recesses 124, 136 are directly opposite one another on the pocket. The distance between the recesses 124, 136 defines a width W2.

The pocket 112 is described herein as being generally trapezoidal, though the shape may also be technically considered as an irregular hexagonal shape. The two end legs 118, 130 jointly define the first side of the irregular hexagon, and each of the outwardly extending legs 120 and 132 and the inwardly extending legs 122 and 134 define a side of the irregularly shaped hexagon. The final side of the irregular hexagon is formed by the opening 140 of the pocket 112.

The pocket 112 is configured such that the nominal width W1 (i.e. the width in the unexpanded or natural state of the pocket) of the pocket 112 at the opening 140 is less than the nominal width W2 of the pocket 112 between the recesses 124, 136. The nominal width W3 of the pocket 112 at the end legs 118, 130 is less than both the nominal width W1 of the opening 140 and the nominal width W2 between the recesses 124, 136.

In one particular embodiment, the nominal interior width W1 at the opening 140 is approximately 7 cm, the nominal interior width W2 between the recesses 124, 136 is approximately 8.5 cm, and the nominal interior width W3 at the end legs 118, 130 is approximately 2.5 cm. Additionally, in this particular embodiment, the nominal length L1 of the pocket 112 between the opening 140 and the recesses 124, 136 is approximately 1.5 cm, while the nominal length L2 of the pocket between the recesses 124, 136 and the end legs 118, 130 is approximately 10 cm. In other embodiments, however, other suitable dimensions are used for the pocket 112.

The sleeve 104 is formed of an elastic material and/or compression material, for example, spandex, elastane, or Lycra®, to enable the sleeve 104 and the pocket 112, to be stretched. The elastic and/or compression material may be provided by a resilient textile possessing stretch and recovery properties. That is, the resilient textile possesses the ability to expand from its original shape/dimensions (stretch), as well as to contract, returning to its original shape/dimensions (recover). Accordingly, the resilient textile expands when a tension is placed on the textile (e.g., along the machine direction and/or along the non-machine direction). The stretch of the textile may be directional. For example, the textile may possess four-way or two-way stretch capabilities. A textile with "four way" stretch capabilities stretches in a first direction and a second, directly-opposing direction, as well as in a third direction that is perpendicular to the first direction and a fourth direction that is directly opposite the third direction. In other words, a sheet of four-way stretch material stretches in both crosswise and lengthwise.

In the illustrated embodiment, the sleeve 104 is a standalone compression sleeve. In another embodiment depicted in FIG. 11, a long-sleeve shirt 200 includes the sleeve 104 having the pocket 112 as one sleeve or as both sleeves. While the long-sleeve shirt 200 may include a pocket 112 on each arm, the reader should appreciate that, when used by a baseball hitter, the long-sleeve shirt 200 is designed such that the pad element 108 is inserted in only one of the pockets 112 at a given time. In further embodiments, the sleeve 104 may be part of any other suitable garment or article of apparel that extends past a user's elbow or can be worn on the user's arm. In still other embodiments, the sleeve is configured to be worn on a user's knee, shin, ankle, thigh, upper arm, forearm, wrist, or other location where protection is desired.

Figure 2:
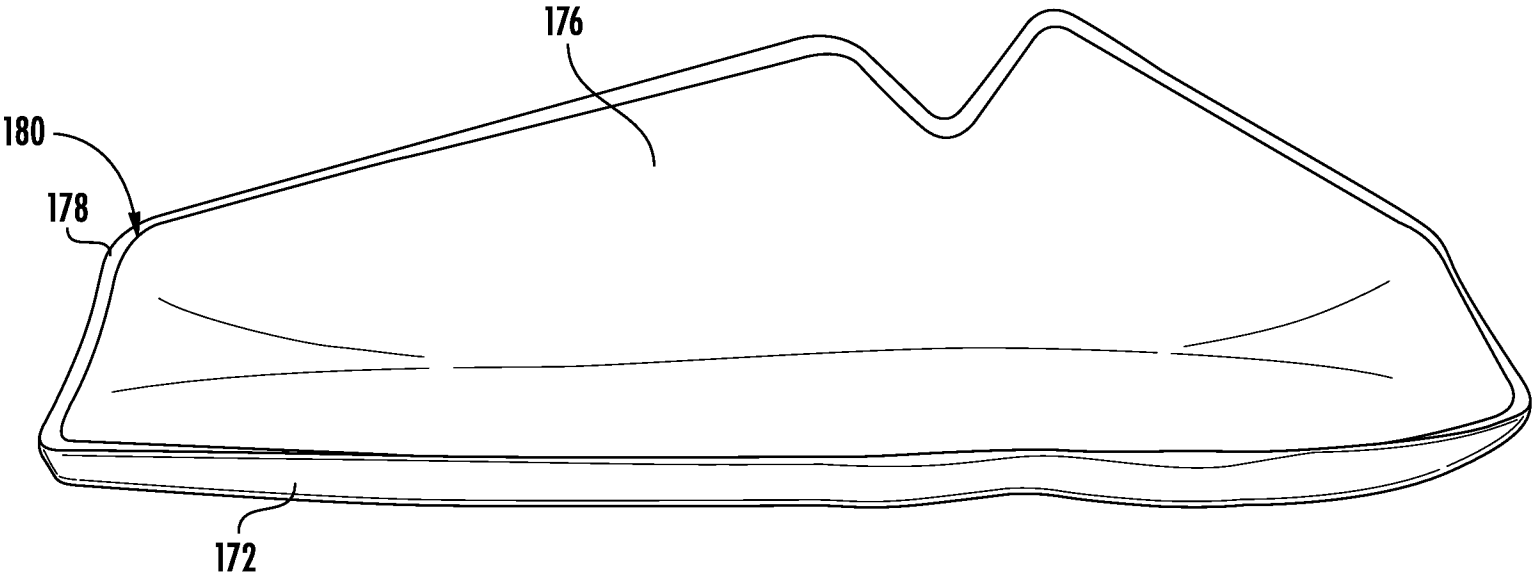
FIG. 2 is a rear perspective view of the pad element of the elbow guard arrangement of FIG. 1.

With reference to FIGS. 1 and 2, the pad element 108 is curved around its longitudinal axis and includes a first portion 152, which may also be referred to as a proximal portion, on a proximal side (i.e. toward a proximal end 153) of the pad element 108 and a second portion 154, which may also be referred to as a distal portion, on a distal side (i.e. toward a distal end 155) of the pad element 108.

The first portion 152 is generally shaped as a trapezoid when viewed from above as in FIG. 1, and is complementary to the pocket 112, by which is meant the first portion 152 has generally the same shape and is capable of substantially filling the pocket 112. The widest portion 156 of the first portion 152 is located nearest the second portion 154 of the pad element 108. The second portion 154 also has a generally trapezoidal shape when viewed from above, with the shorter base at the end remote from the first portion 152. The widest portion 158 of the second portion is located nearest the first portion 152.

The pad element 108 defines a notch 162, 164 on each side of the pad element 108 at an intermediate portion 160 between the first portion 152 and the second portion 154. Each notch 162, 164 is defined by a vertex that forms an interior angle (i.e., the angle formed between the two segments meeting at the vertex) that is less than 180°. In one embodiment, the interior angle of the notches 162, 164 is between 70° and 110°.

The second portion 154 of the pad element 108 has a narrow end having a width W4, expands to the widest portion 158 having width W5 adjacent the notches 162, 164, and narrows to the width W6 measured at the vertices of the notches 162, 164. The first portion 152 of the pad element 108 expands from the width W6 at the vertices of the notches 162, 164 to the width W7 at the widest portion 156 of the first portion 152, and then narrows to the narrowest width W8 of the first portion 152. Accordingly, it will be recognized that the width W6 of the pad element 108 between the notches 162, 164 is significantly different from the width W5 and W7 of the pad element at locations immediately adjacent to the notches 162, 164. Additionally, the widest portion 158 of the second portion 154 is configured to have a greater width W5 than the width W7 at the widest portion 156 of the first portion 152. The width W5 widest portion 158 of the second portion 154 is sufficiently great to prevent or at least make it difficult for user to insert the second portion 154 of the pad element 108 into the pocket 112. Additionally, when the pad element 108 is inserted into the pocket, engagement of the proximal end of the pad element 108 with the end legs 118, 130 prevent further insertion of the pad element 108 in to the pocket 112.

In one particular embodiment, the narrow end (which may also be referred to as the distal end) of the second portion 154 has a width W4 of approximately 4 cm, and the span of the second portion 154 at a location immediately adjacent to the notches 162, 164 has a width W5 of approximately 9 cm. In this embodiment, the length L3 between the distal end 155 and the widest portion 158 is approximately 5 cm. The width W6 extending between the vertices of the notches 162, 164 is approximately 6.5 cm, while the length L4 between the widest portion 158 of the second portion 154 and portion between the vertices of the notches 162, 164 (at W6) is approximately 1.5 cm. In this particular embodiment, the width W7 of the widest section of the first portion 152 is approximately 8 cm, and the length L5 between the narrowest distance between the notches 162, 164 and the widest portion of the first portion 152 is approximately 1.5 cm. The proximal end of the first portion 152 has a width W8 of approximately 4 cm, and is spaced from the widest part 156 of the first portion 152 by a length L6 of approximately 9.5 cm. In this described embodiment, the widths W4-W7 are measured in the plane perpendicular to the longitudinal axis of the pad element 108. The curvature of the pad element 108 about the longitudinal axis may result in the arc length of the pad element 108 along the various widths W4-W7 being greater than the widths W4-W7 in the plane perpendicular to the longitudinal axis of the pad element 108. The reader should appreciate that in other embodiments, the dimensions of the pad element are different depending on the desired use of the pad element.

In the illustrated embodiment, the pad element 108 is formed of a relatively inelastic hard plastic shell 172 and a resilient foam portion 176 (FIG. 2). The hard plastic shell 172 is located on the outside of the pad element 108 to provide structural stability to the pad element 108 in the event of sudden impacts on the pad element 108. The hard plastic shell 172 includes an outer surface having a perimeter edge and a lip 178 extending entirely around the perimeter edge of the pad element 108 and forming a recess 180 in which the resilient foam portion 176 is arranged. The resilient foam portion 176 generally has a thickness that is approximately the same as the height of the lip 178 such that the lip 178 and the resilient foam portion 176 extend the same distance from the outer surface of the hard plastic shell 172. In other words, the lip 178 and the resilient foam portion 176 are substantially flush with one another.

In various embodiments, the hard plastic shell 172 is formed of at least one of polyvinyl chloride ("PVC"), polypropylene, acrylonitrile butadiene styrene ("ABS"), polycarbonate, or another suitable polymer having high impact resistance. In some embodiments, the hard plastic shell 172 is configured with a smooth, glossed, and/or low-friction surface to enable the relatively inelastic hard plastic shell 172, including the lip 178, to slide into the pocket 112 with ease.

The resilient foam portion 176 is provided on the inside of the hard plastic shell 172 and substantially fills the recess 180. The resilient foam portion 176 is configured to cushion the effects of the impacts on the user of the guard arrangement 100. In various embodiments, the resilient foam portion is formed of one or more of polyethylene, polystyrene, polyurethane, thermoplastic polyurethane ("TPU"), expanded TPU, ethylene-vinyl acetate (EVA) or another suitable shock-absorbing foam.

While the embodiment is described with a hard plastic shell and a resilient foam portion, the reader should appreciate that, in other embodiments, the outer portion is formed of another suitable structural material, for example a composite fiber, and/or the inner portion is formed of another suitable shock-absorbing or impact-absorbing material. In still further embodiments, the pad element 108 is formed of a single material that provides both the structural support and the cushioning for the pad element.

The hard plastic shell 172 is described as being relatively inelastic, by which is meant the elasticity of the hard plastic shell 172 is less than the elasticity of the material from which the sleeve 104 is formed. In one particular embodiment, the hard plastic shell 172 may be considered as being inelastic or rigid. The relative inelasticity of the hard plastic shell 172 relative to the sleeve 104 means that application of a relatively small force, which is sufficient to cause the elastic fabric forming the sleeve 104 to deform, does not cause deformation of the hard plastic shell 172. As discussed in detail below, the relative inelasticity of the hard plastic shell 172 relative to the sleeve 104 enables the user to insert the hard plastic shell 172 into the opening 140 to deform the fabric around the opening 140 to enlarge the opening 140 and enable the first portion 152 of the pad element 108 to be inserted into the pocket 112.

Figure 10:
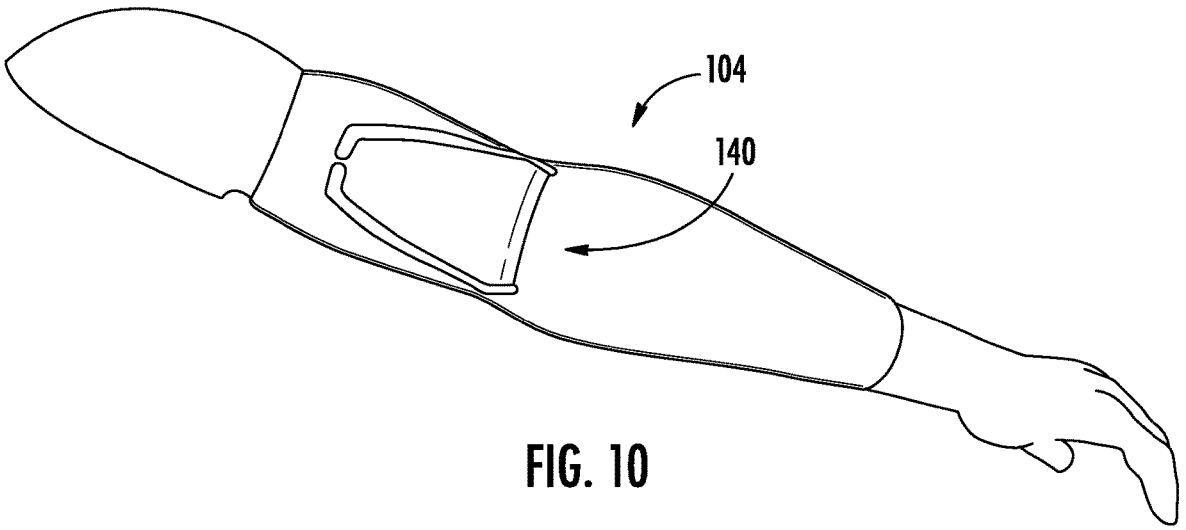
FIG. 10 is a front view of the sleeve of the elbow guard arrangement of FIG. 1 being worn on an arm.

To use the guard arrangement 100, the user dons the sleeve 104, which, in the illustrated embodiment, is a compression sleeve pulled over the user's arm. In particular, for use by a batter in baseball, the sleeve is worn with the opening 140 facing the distal end of the batter's arm (see, e.g., FIG. 10) on the arm opposite the side of the plate from which the player is hitting, also referred to as the batter's "lead arm," so as to protect the elbow facing toward the pitcher. For example, a batter hitting right handed uses the sleeve on the left arm, while a batter hitting left handed uses the sleeve on the right arm.

Figure 3:
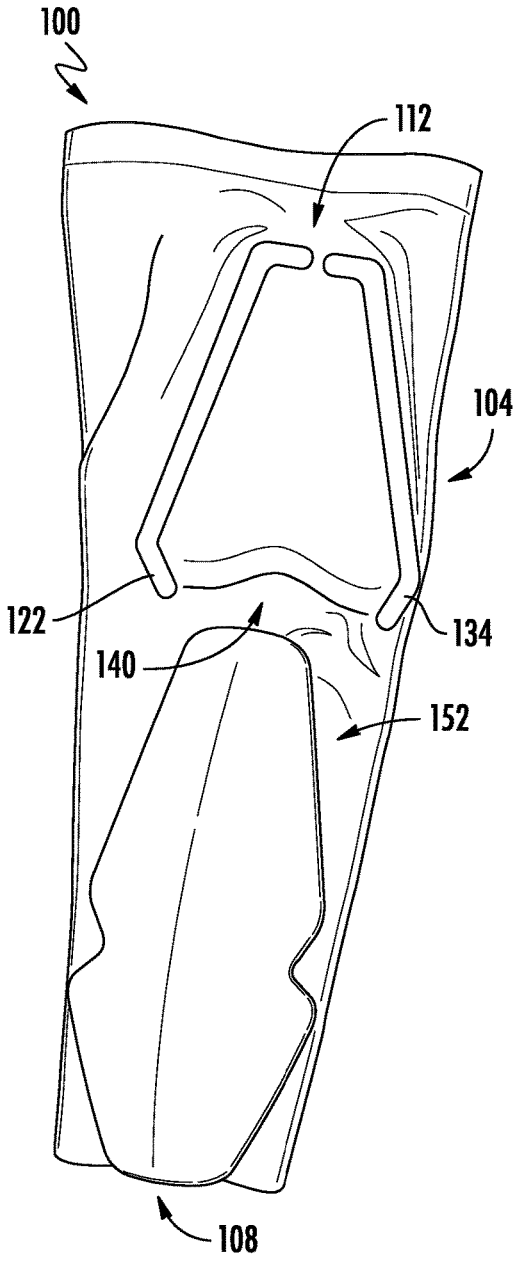
FIG. 3 is a front view of the elbow guard arrangement of FIG. 1 with the pad element aligned with a pocket of the sleeve.
Figure 4:
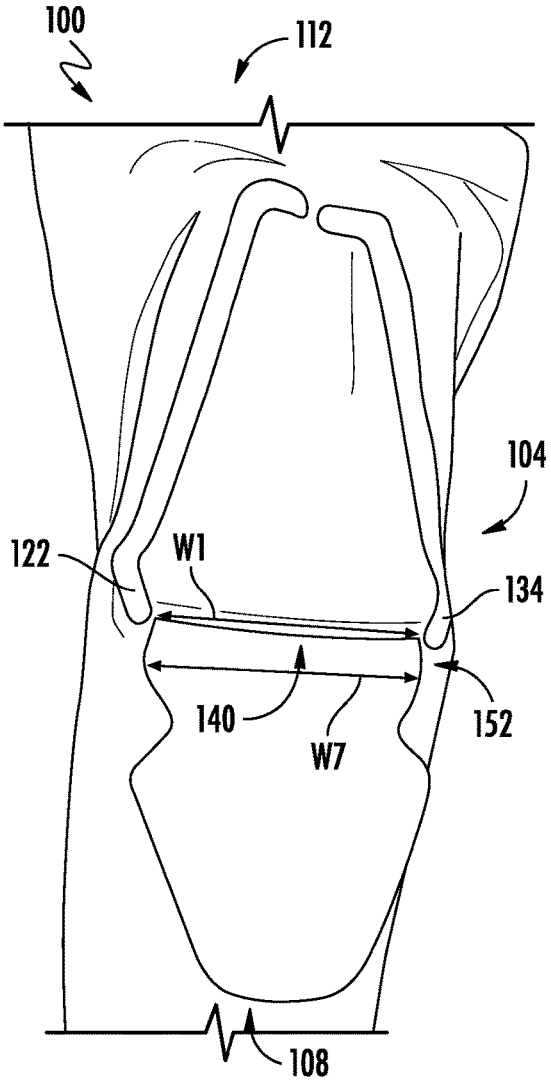
FIG. 4 is a front view of the elbow guard arrangement of FIG. 1 with the pad element partially inserted into the pocket of the sleeve.

The user then aligns the end of the first portion 152 of the pad element 108 with the opening 140 of the pocket 112, as depicted in FIG. 3. The user slides the first portion 152 into the opening 140, as illustrated in FIG. 4. The pad element 108 is configured such that the greatest width W7 of the first portion 152 of the pad element 108 is wider than the width W1 between the inwardly extending legs 122, 134 in the unstretched, or nominal, state of the sleeve 104.

Figure 5:
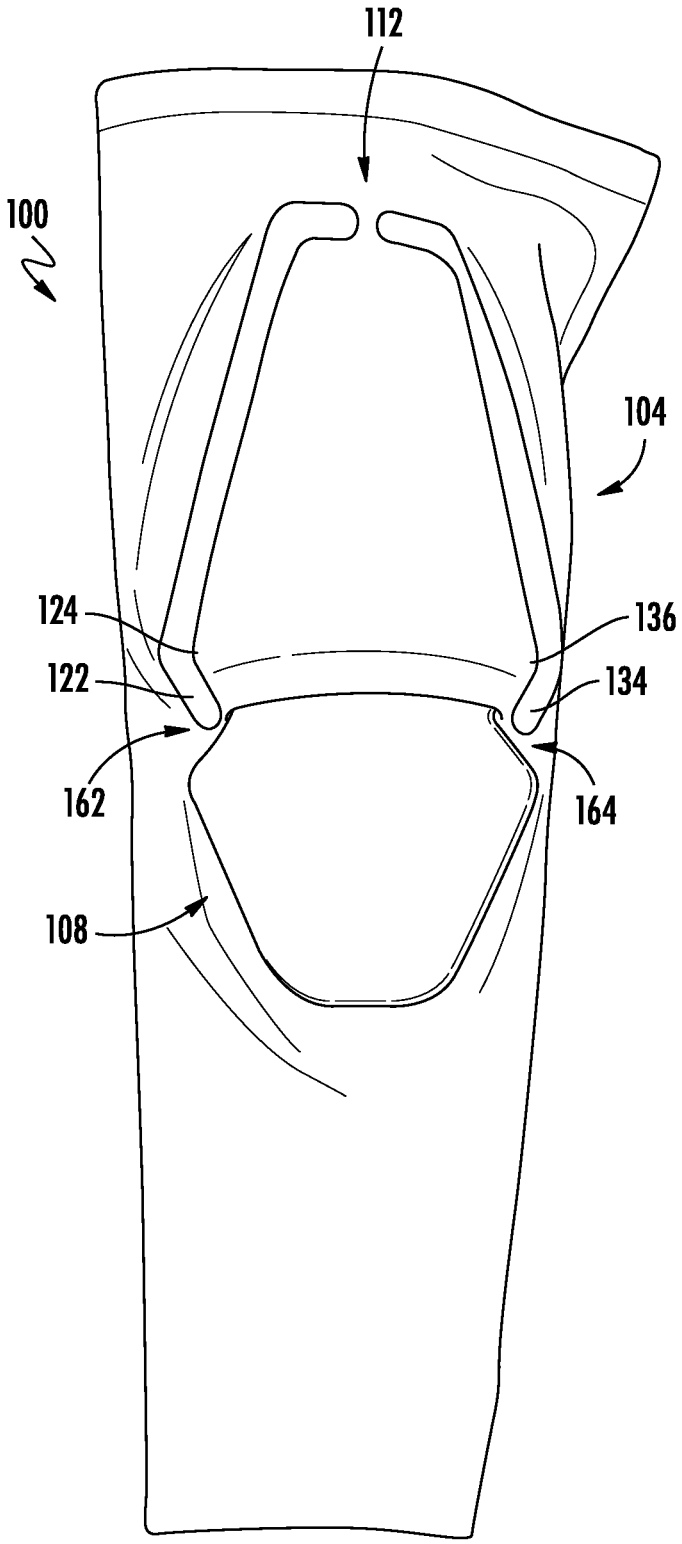
FIG. 5 is a front view of the elbow guard arrangement of FIG. 1 with the pad element fully inserted into the pocket of the sleeve.

Since the sleeve 104 is formed of an elastic material and the pad element 108 has a relatively inelastic hard plastic shell 172, the size and shape of the opening 140 are adjustable. The sleeve 104 stretches elastically from the force exerted by the user pressing the pad element 108 into the opening 140 to expand the opening 140 and enable the widest section of the first portion 152 of the pad element 108 to pass between the inwardly extending legs 122, 134 and through the opening 140 at the mouth of the pocket 112 to the installed position, shown in FIGS. 5 and 6. The outer surface and lip 178 of the relatively inelastic hard plastic shell 172 are smooth to enable the pad element 108 to slide against the sleeve 104 to facilitate inserting the pad element 108 in the pocket 112 while stretching the pocket 112 and sleeve 104 elastically. In the installed position, the pad element 108 is positioned to protect the user's elbow.

The widest section of the first portion 152, at W7, is configured to fit complementarily in the recesses 124, 136 of the pocket 112, while the inwardly extending legs 122, 136 fit complementarily in the notches 162, 164 of the pad element 108. The intermediate portion 160 is partially enclosed in the pocket 112, and partially extending outside the opening 140 of the pocket 112. The pad element 108 is locked or generally secured in the pocket 112 by the interaction between the first and intermediate portions 152, 160 of the relatively inelastic hard plastic shell 172 of the pad element 108 and the elastic compression of the sleeve 104 such that the pad element 108 is prevented from falling out of the pocket 112 without external force being applied to the pad element 108. Since the pad element 108 is secured in the pocket 112, the user can bend his or her elbow, for example to hold a baseball bat in a hitting stance (FIGS. 7, 8, and 9), without the pad element 108 falling out of the pocket 112.

Figure 7:
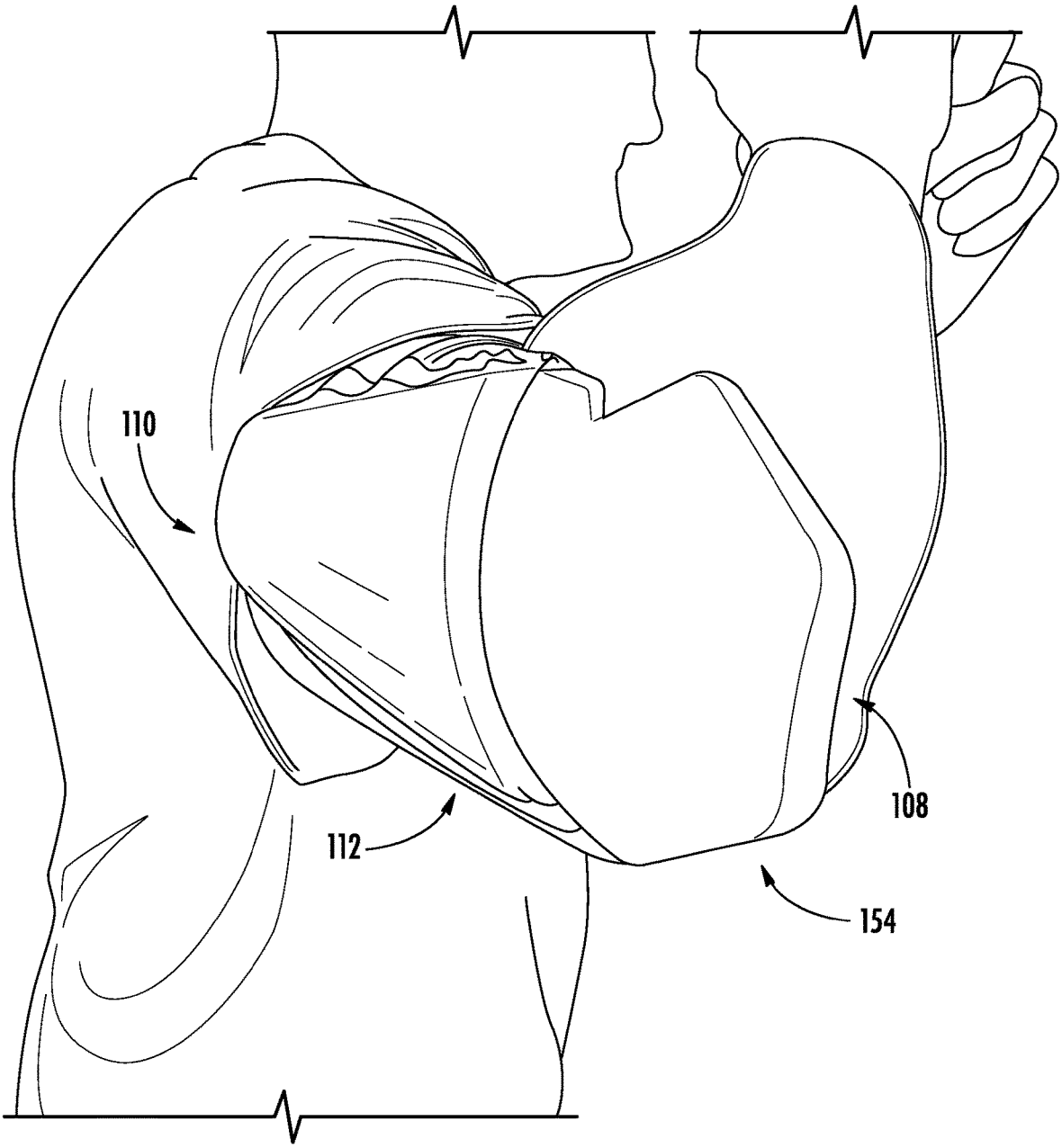
FIG. 7 is a side perspective view of a user wearing the elbow guard arrangement of FIG. 1 in a hitting stance.
Figure 8:
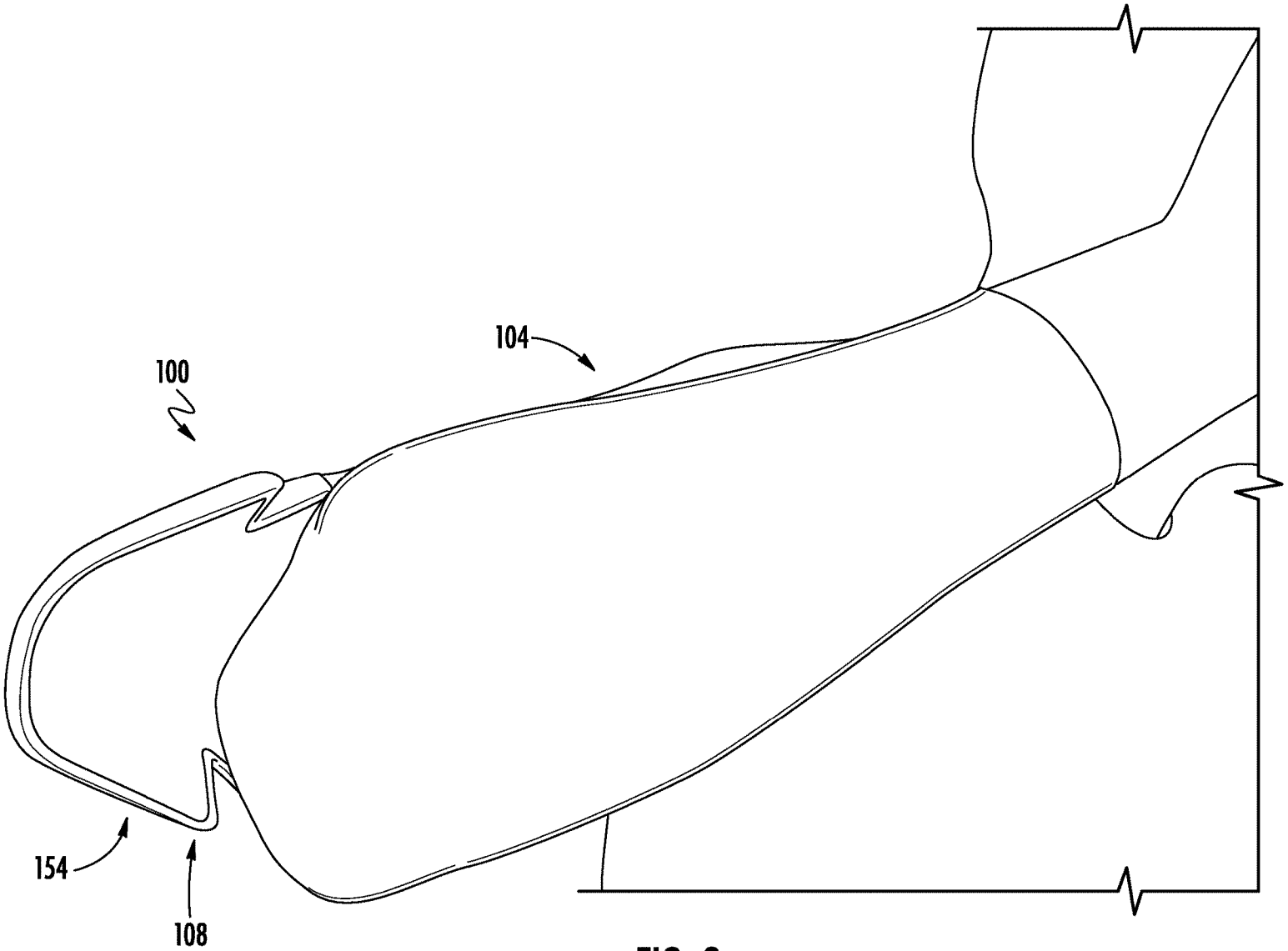
FIG. 8 is a front perspective view of the user wearing the elbow guard arrangement of FIG. 1 in the hitting stance of FIG. 7.
Figure 9:
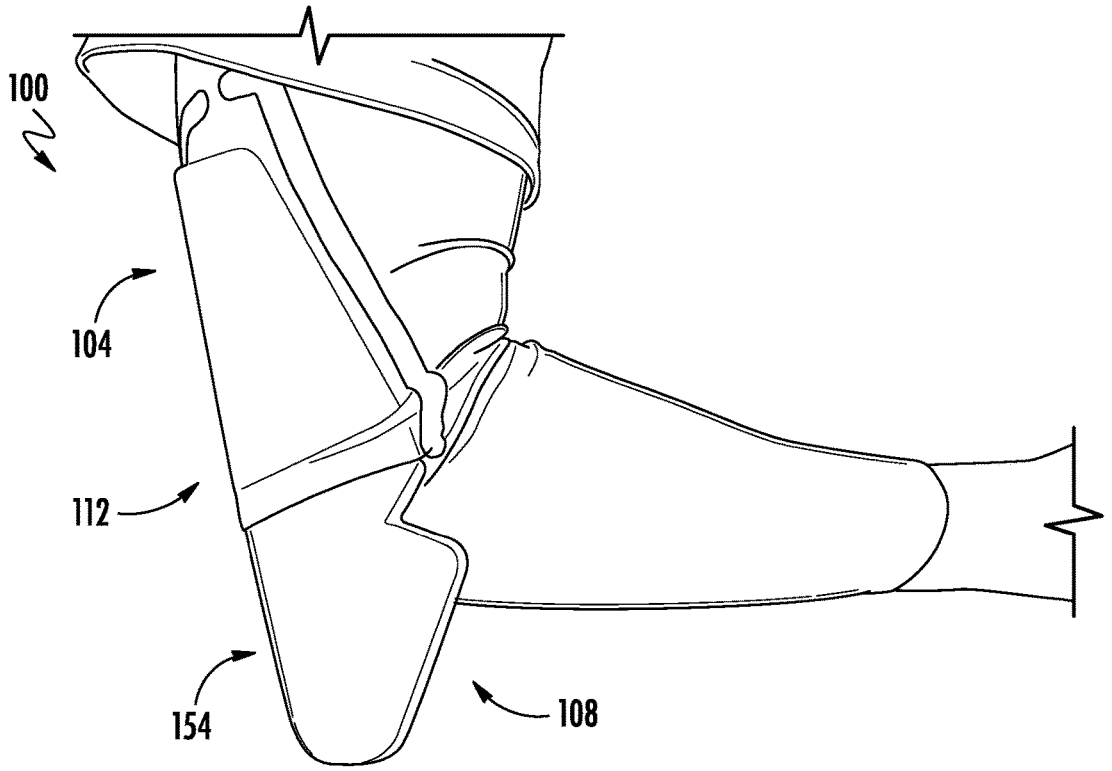
FIG. 9 is a side perspective view of the user wearing the elbow guard arrangement of FIG. 1 in another hitting stance.

Moreover, as illustrated in FIGS. 7-9, when the user is in a hitting stance, part of the intermediate portion 160 and the entire second portion 154 of the pad element 108 extend out from the pocket 112 past the user's elbow. The pad element 108 therefore provides protection from a user against being hit with the baseball on at least part of the forearm, in addition to protection of the user's elbow.

Once the user is done batting, or otherwise desires to remove the pad element 108, the user manipulates the second portion 154, which extends out from the pocket 112, to pull the pad element 108 out from the pocket 112.

Figure 11:
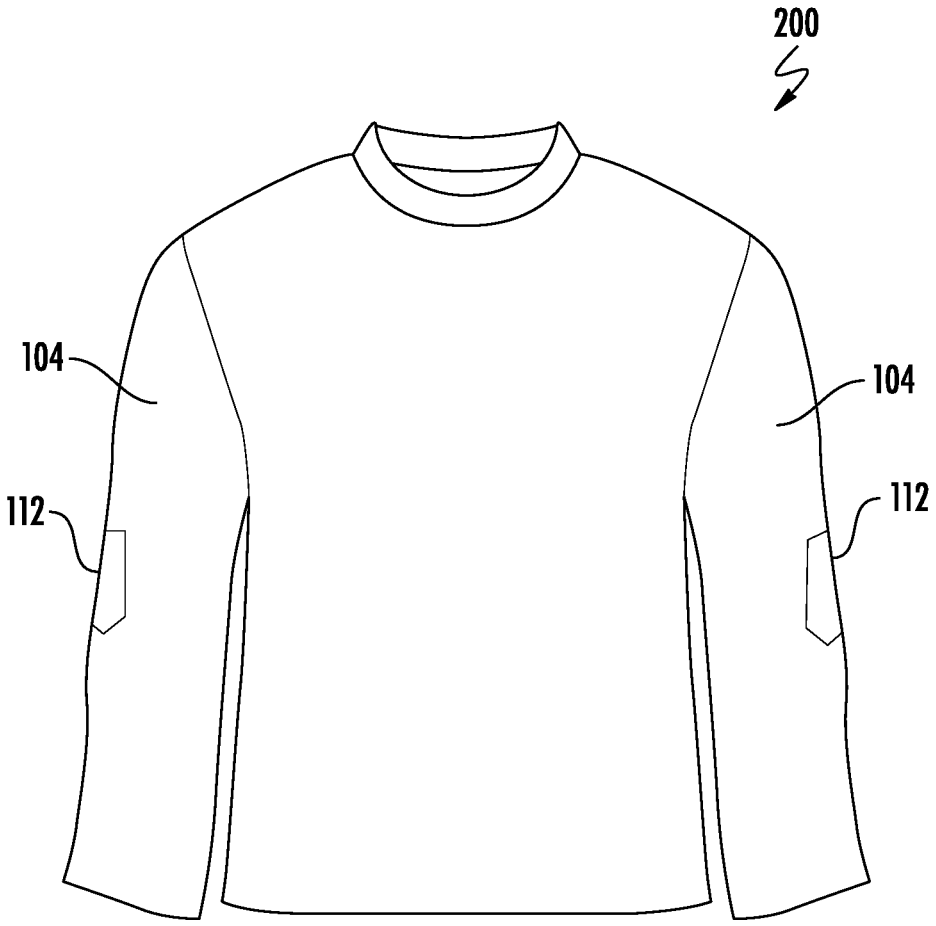
FIG. 11 is a schematic view of a long sleeve garment having pockets of the pad arrangement.

In the illustrated embodiment, the guard arrangement 100 is designed to be worn by a batter on the elbow region of his or her arm that is facing toward the pitcher. In the embodiment illustrated in FIGS. 1-9, the user could wear a single sleeve 104 on the arm opposite his or her non-dominant hand, or, particularly for a switch-hitter, the user may wear the sleeve 104 on both arms. In some embodiments, for example as illustrated in FIG. 11, the sleeve 104 is part of a long-sleeve shirt 200 that has a pocket 112 on the arm opposite the user's non-dominant hand, or the long-sleeve shirt 200 may have a pocket 112 on each sleeve. However, even when the batter has a pocket 112 on each arm, the guard arrangement 100 is designed such that the user only inserts the pad element 108 into the pocket 112 on the arm facing the pitcher, and does not use the pad element 108 on the arm opposite the pitcher (i.e. the back or rear arm). Accordingly, in typical use, the pad element is only provided on a solitary limb of the user (e.g., the left or right arm only) and not on any additional limb.

While the described embodiment illustrates an elbow guard, the reader should appreciate that the sleeve and pad arrangement could be used for other sports and/or at other positions on the user's body. For example, the notch arrangement of the pocket and pad element is useful to retain a soccer player's shin guard in position while playing, but enable the pad to be inserted and removed easily. Other examples where the disclosed pad arrangement is useful are lacrosse pads, hockey pads, certain football pads, for example knee pads, baseball catchers' pads, volleyball knee or elbow pads, pads for motorcycle riders, and any other desired padding arrangement.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An article of apparel comprising:

a sleeve including a pocket in an elbow region of the sleeve, the pocket including an opening defining a width; and a pad element including a first portion positioned inside the pocket and a second portion positioned outside the pocket, the first portion having a width at a widest part of the first portion that is greater than the width of the opening, the pad element including at least one notch located on the pad element between the first and second portions, wherein at least one notch is arranged at the opening of the pocket.

2. The article of apparel of claim 1, wherein the first portion of the pad element is removably positioned in the pocket and is complementary in shape to the pocket.

3. The article of apparel of claim 1, wherein the second portion of the pad element extends from the pocket in the elbow region of the sleeve.

4. The article of apparel of claim 1, wherein the pocket includes a first side and a second side, the opening being defined between the first side and the second side at a distal end of the pocket.

5. The article of apparel of claim 4, wherein the first side defines a first recess and the second side defines a second recess, wherein a pocket width between the first and second recesses is greater than the width of the opening, and wherein the widest part of the first portion of the pad element is accommodated in the first and second recesses of the pocket.

6. The article of apparel of claim 1, wherein the at least one notch defines a vertex having an interior angle of between 70° and 110°.

7. The article of apparel of claim 1, wherein a width of a widest part of the second portion of the pad element is greater than the width of the widest part of the first portion of the pad element.

8. The article of apparel claim 7, wherein the at least one notch includes two notches defined in an intermediate portion of the pad element positioned longitudinally between the widest part of the first portion and the widest part of the second portion.

9. The article of apparel of claim 8, wherein the width of the opening is approximately 7 cm, the width at the widest part of the first portion is approximately 8 cm, the width of the widest part of the second portion is approximately 9 cm, and a width of the intermediate portion between the two notches is approximately 6.5 cm.

10. The article of apparel of claim 9, wherein a first length measured along a longitudinal axis of the pad element from a distal end to the widest part of the second portion is approximately 5 cm, a second length measured along the longitudinal axis from the widest part of the second portion to the two notches is approximately 1.5 cm, a third length measured along the longitudinal axis from the two notches to the widest part of the first portion is approximately 1.5 cm, and a fourth length measured along the longitudinal axis from the widest part of the first portion to a proximal end of the pad element is approximately 9.5 cm.

11. The article of apparel of claim 1, wherein the pad element has a longitudinal axis defined from a distal end to a proximal end of the pad element, and the pad element is curved about the longitudinal axis.

12. The article of apparel of claim 1, wherein the pad element comprises a hard plastic shell that is relatively inelastic as compared to the sleeve.

13. A method of protecting a lead elbow of a baseball or softball batter comprising:

donning an elongated sleeve body having a pocket positioned thereon, the pocket having a first side and a second side and defining an opening at a distal end of the pocket, wherein the first side defines a first recess and the second side defines a second recess in the pocket, and wherein a width of the pocket between the first and second recesses is greater than a width of the opening;

inserting a first portion of a pad element into an adjustable pocket opening, the first portion of the pad element having a width at a widest part of the first portion that is greater than a width of the pocket opening;

engaging at least one notch on an intermediate portion of the pad element with the pocket opening such that a second portion of the pad element extends from the pocket opening outside of the pocket; and batting with the first portion of the pad element in the pocket and the second portion projecting outwardly from the pocket.

14. The method of claim 13, the inserting of the first portion further comprising:

inserting a relatively inelastic hard plastic shell of the first portion of the pad element into the opening such that the hard plastic shell deforms the opening so as to enable the first portion to pass through the opening.

15. The method of claim 13 wherein the opening is an adjustable opening, and wherein inserting the pad element into the pocket includes stretching the opening to allow the widest part of the first portion to enter the pocket.

16. The method of claim 13 wherein the act of batting includes bending the lead elbow such that the second portion of the pad element projects outwardly from the lead elbow, the method further comprising removing the first portion of the pad element from the pocket after batting.

17. An elbow guard comprising:

an elongated sleeve body;

a pocket positioned on the elongated sleeve body, the pocket having a first side and a second side and defining an opening at a distal end of the pocket, wherein the first side defines a first recess and the second side defines a second recess in the pocket, and wherein a width between the first and second recesses is greater than a width of the opening; and a pad element having a first portion positioned in the pocket, a second portion extending outside the pocket, and an intermediate portion arranged between the first and second portions, wherein a widest part of the first portion is wider than the width of the opening, and wherein a notch is defined in the pad element at the intermediate portion, the opening engaging the notch.

18. The elbow guard of claim 17, wherein the widest part of the first portion engages the first and second recesses in the pocket.

19. The elbow guard of claim 17 wherein the pad element comprises a relatively inelastic hard plastic shell and a relatively soft interior pad, the shell having a continuous surface extending from the first portion to the second portion.

* * * * *